US008899611B2

(12) United States Patent
Alzner et al.

(10) Patent No.: US 8,899,611 B2
(45) Date of Patent: Dec. 2, 2014

(54) BOOT RETAINING UNIT WITH DAMPING

(71) Applicant: MARKER Deutschland GmbH, Penzberg (DE)

(72) Inventors: Simon Alzner, Munich (DE); Manfred Bader, Eglfing (DE); Markus Krumbeck, Farchant (DE); Michael Mangold, Grainau (DE)

(73) Assignee: MARKER Deutschland GmbH, Penzberg (DE)

( * ) Notice: Subject to any disclaimer, the term of this patent is extended or adjusted under 35 U.S.C. 154(b) by 0 days.

(21) Appl. No.: 13/906,927

(22) Filed: May 31, 2013

(65) Prior Publication Data

US 2013/0334795 A1 Dec. 19, 2013

(30) Foreign Application Priority Data

Jun. 1, 2012 (DE) ..... 10 2012 209 339

(51) Int. Cl.

| | |
|---|---|
| ***A63C 9/08*** | (2012.01) |
| ***A63C 9/00*** | (2012.01) |
| ***A63C 9/085*** | (2012.01) |
| ***A63C 10/26*** | (2012.01) |
| ***A63C 9/084*** | (2012.01) |

(52) U.S. Cl.

CPC . *A63C 10/26* (2013.01); *A63C 9/00* (2013.01); *A63C 2203/20* (2013.01); *A63C 9/08571* (2013.01); *A63C 9/08564* (2013.01); *A63C 9/08521* (2013.01); *A63C 9/0843* (2013.01)

USPC ..... 280/634; 280/626

(58) Field of Classification Search

CPC ..... A63C 9/08; A63C 9/085; A63C 9/08507; A63C 9/08521; A63C 9/08557; A63C 9/08578; A63C 9/08585

USPC ..... 280/613, 623, 625, 626, 629, 630, 631, 280/632, 634

See application file for complete search history.

(56) References Cited

U.S. PATENT DOCUMENTS

| | | | | |
|---|---|---|---|---|
| 3,893,684 | A * | 7/1975 | Schweizer | 280/634 |
| 4,372,574 | A | 2/1983 | Svoboda et al. | |
| 4,457,534 | A * | 7/1984 | Richert | 280/631 |
| 5,957,481 | A | 9/1999 | Stepanek et al. | |
| 6,588,791 | B1 * | 7/2003 | Horn | 280/613 |

FOREIGN PATENT DOCUMENTS

| | | | |
|---|---|---|---|
| AT | 397 469 | B | 4/1994 |
| DE | 29 16 352 | C2 | 11/1979 |
| EP | 0 829 280 | B1 | 3/1998 |

OTHER PUBLICATIONS

German Office Action for Application No. 10 2012 209 339.7 mailed May 16, 2013.

* cited by examiner

*Primary Examiner* — John Walters
(74) *Attorney, Agent, or Firm* — RatnerPrestia

(57) ABSTRACT

A boot retaining unit of a ski binding or snowboard binding, including at least one boot retaining element, a restoring spring for the boot retaining element, and a damping device for absorbing short, hard impacts, wherein the at least one boot retaining element and the damping device are connected via a translation mechanism, and the translation mechanism translates a deflection of the at least one boot retaining element into a larger deflection of the damping device.

15 Claims, 10 Drawing Sheets

BOOT RETAINING UNIT WITH DAMPING

CROSS REFERENCE TO RELATED APPLICATION

This application claims priority to German Application No. 10 2012 209 339.7, filed Jun. 1, 2012, the contents of such application being incorporated herein by reference.

FIELD OF THE INVENTION

The invention relates to a boot retaining unit of a ski binding or snowboard binding, comprising at least one boot retaining element, a restoring spring for the boot retaining element, and a damping device for absorbing short, hard impacts. The at least one boot retaining element and the damping device are connected via a translation mechanism which translates a small deflection of the at least one boot retaining element into a larger movement at the damping device.

BACKGROUND OF THE INVENTION

It is known that the releasing force for a ski binding or snowboard binding can be set such that the safety binding is reliably released in the event of a fall. A fall can be compared to a relatively slow impact—relative to impacts such as can for example occur when moving over small bumps. Such short, hard impacts can cause the safety binding to be accidentally released and the skier or snowboarder to therefore fall over. Safety bindings have therefore been developed which comprise damping devices, wherein the damping devices damp the short, hard impacts enough that the safety binding is accidentally released more rarely.

EP 0 829 280 B1, for example, which is incorporated by reference, proposes a damping device for a boot retaining unit, consisting of a cylinder filled with a hydraulic medium which is paste-like in its resting state, wherein the short, hard impacts are transmitted directly from the boot retaining unit to the damping device.

SUMMARY OF THE INVENTION

It is therefore an aspect of the present invention to provide a safety binding which comprises a boot retaining unit and a toe retainer or heel retainer and which further reduces the danger of being accidentally released in the event of short, hard impacts.

One embodiment relates to a boot retaining unit of a ski binding or snowboard binding, comprising at least one boot retaining element, a restoring spring for the boot retaining element, and a damping device for absorbing short, hard impacts, wherein the at least one boot retaining element and the damping device are connected via a translation mechanism which translates a small movement of the at least one boot retaining element into a larger movement at the damping device.

The boot retaining unit can be a toe retainer or heel retainer of a safety binding for a ski or snowboard. The restoring spring is the spring which presses the boot retaining unit or at least a boot retaining element against the ski boot or snowboard boot, in order to fixedly connect the ski boot or snowboard boot to the respective sports equipment. The ski boot or snowboard boot can be removed from the binding at the toe end or heel end, against the resistance of the restoring spring.

The force which the restoring spring exerts can be set to a body weight and to the sporting abilities of the skier or snowboarder.

A small deflection of the boot retaining unit or one of the boot retaining elements is transmitted onto the damping device by the translation mechanism, wherein one end of a transmitting element cooperates directly or indirectly with the at least one boot retaining element, while the other end acts on the damping device, wherein the translation mechanism is designed, for example as a lever connection, such that the small deflection of the boot retaining element is translated into a larger movement of the damping device, which causes short, hard impacts acting on the boot retaining element to be effectively damped, wherein the deflection of the boot retaining unit can for example be measured in angular degrees, while the damping movement can be measured in mm.

The damping device only acts in the event of short impacts, since it exhibits a shorter reaction time than the restoring spring, i.e. if an impact or force acts on the boot retaining element transversely or obliquely with respect to the direction of travel, this force will be transmitted onto the restoring spring and the damping device simultaneously. If the force occurs suddenly, it will be absorbed by the damping device, and the restoring spring will be compressed to a lesser degree than would be expected on the basis of the magnitude of the force occurring. This prevents the boot retaining element from being released and the skier or snowboarder from falling over, despite a force being applied which is above the releasing force for the restoring spring.

By contrast, if the force acts on the restoring spring and the damping device at a "normal speed", then the restoring spring is compressed in accordance with the force acting on it, while the damping device is simultaneously moved along with it, without exerting any appreciable damping effect. The boot retaining element can then be released.

The translation mechanism can be a translation mechanism which transmits a force acting on the at least one boot retaining element, which causes the deflection, onto a damper of the damping device via at least one lever, amplifying it in the process. One known translation mechanism is the lever, which can be rotated about a fulcrum and which, due to the different lengths of the parts of the lever in front of and behind the fulcrum, can translate a force applied to one end of the lever into a larger force at the other end of the lever. The lever can be formed in one piece or can comprise two lever portions which are connected by means of a joint.

The lever can then comprise a first lever portion which is coupled to the at least one boot retaining element, and a second lever portion which is coupled to the damper, wherein the two lever portions can be pivoted in a pivot joint about a common pivot point.

The damping device is preferably restored from an activated state to its resting state by the restoring spring for the boot retaining element, i.e. when the restoring spring, which is also elastically compressed by the short impacts, then expands to its length before the short, hard impact occurred, it simultaneously guides the damping device back into the latter's initial position before the short, hard impact occurred, i.e. the force implemented into the restoring spring by the compression simultaneously causes the boot retaining element and the damping device to be restored. The latter can only be caused by the restoring spring if the damping device is mechanically coupled to the at least one boot retaining element such that a restoring movement of the boot retaining element necessarily acts on the damping device due to the restoring spring. Such a mechanical coupling can for example be an arrangement of rods, in which the individual rods are fixedly connected to each other, for example in pivot joints, wherein the first rod can be fixedly connected to the boot retaining element, and the final rod can be fixedly connected to the damper.

Alternatively, the damper and the boot retaining element(s) can also be connected by a mechanism which only abuts the damper and/or boot retaining element in its resting state, without exhibiting a fixed connection. In this case, the restoring spring only restores the boot retaining element(s) and as applicable a part of the mechanism to its/their resting state after a deflection, while the damper returns to its resting state separately and as applicable slaves a part of the mechanism in the process.

The restoring spring can be arranged transverse to or along a longitudinal axis of the ski binding or snowboard binding, depending on the design of the boot retaining unit. The longitudinal axis of the ski binding always coincides with a longitudinal axis of the ski and points in the direction of travel. With snowboards, however, there are different ways of fastening the ski bindings on the board, wherein the longitudinal axis of the snowboard binding is generally not identical to the direction of travel of the snowboard.

In another embodiment, the at least one boot retaining element can be connected directly to the translation mechanism, for example in a pivot joint in which the boot retaining element can be pivoted relative to the translation mechanism. The ends of the boot retaining element and translation mechanism which form the pivot joint exhibit a common pivot axis, for example in the form of a tube, such that the joint connection can transmit tensile forces and pressure forces while the boot retaining element and/or the translation mechanism is simultaneously pivoted.

The at least one boot retaining element can however also be connected to the translation mechanism via a linkage, i.e. the boot retaining element acts for example on a part of a guiding sleeve for the restoring spring, which comprises a linkage guide for the translation mechanism on its side facing away from the boot retaining element and/or is connected to the translation mechanism, for example in a pivot joint.

The guiding sleeve for the restoring spring can consist of two partial sleeves which are separated from each other and are spaced from each other when the restoring spring is in its resting state. If the at least one boot retaining element is then deflected, the two sleeve parts are moved towards each other, i.e. the distance between the mutually opposing ends of the sleeve parts decreases.

Although the sleeve is referred to here as a guiding sleeve, it simultaneously has the function of predetermining the maximum expansion and maximum compression of the spring, i.e. when the two mutually opposing ends of the partial sleeves abut each other in reciprocal contact, the restoring spring is maximally compressed, and when the expanding sleeve spring tenses the at least one boot retaining element fixedly against the ski boot or snowboard boot, it is maximally expanded.

In order to guarantee that the two partial sleeves are securely guided in parallel, one of the partial sleeves can for example comprise a guiding bolt which protrudes centrally beyond the end of the partial sleeve towards the other partial sleeve and which is guided into a hollow cylinder formed on or in the other partial sleeve when the restoring spring is compressed and expanded. Alternatively, one of the partial sleeves can comprise a groove on or in its inner side or outer side, and the other partial sleeve can comprise a guiding element which is adapted to the shape of the groove and is guided in it.

The damping device as a whole or at least a damper of the damping device can be arranged transverse to or along a longitudinal axis of the ski binding or snowboard binding, wherein at least a part of a damper housing can be fixedly connected to the ski, or snowboard, such that it cannot be moved linearly relative to the ski or snowboard. The connection can be a pivot joint in which the damper or at least a part of the damper housing can be pivoted about a fixed pivot axis.

The damper can be a cylinder which is at least partially filled with a damping agent and which comprises a piston, wherein the translation mechanism can act on the cylinder or on the piston such that the piston is pressed into the cylinder when the boot retaining element is deflected. This compresses and/or displaces the damping agent in a unicameral or bicameral cylinder and thus damps the force acting on the boot retaining element and/or the restoring spring. The damping agent can be a liquid which can for example be compressed, for example a hydraulic oil, or a gas which can for example be compressed or a paste-like flux which can for example be compressed.

The cylindrical damper can be arranged in front of the restoring spring as viewed in the longitudinal direction of the ski binding or snowboard binding. In this embodiment, the restoring spring can be arranged transverse to the longitudinal direction of the ski binding or snowboard binding, for example between the two boot retaining elements of a toe retainer, while the damper is arranged in the longitudinal direction of the binding and for example connected to the ski in a pivot joint which lies centrally between the two boot retaining elements of the toe retainer, transverse to the binding.

In an alternative embodiment, the restoring spring can surround the cylinder. In this case, the restoring spring and the damper have to be arranged identically relative to the ski binding or snowboard binding, i.e. both in the longitudinal direction or both in the transverse direction.

In another embodiment, the damping device can comprise a damper in the form of a mass pendulum, i.e. a deflection of the at least one boot retaining element causes a mass pendulum to be deflected out of a resting position. As soon as the force which causes the deflection of the at least one boot retaining element abates or is gone, the mass pendulum can be forced back into its resting state by the restoring spring or alternatively can swing back into its resting state independently of the restoring spring.

In another embodiment of the invention, the damping device can comprise a damper in the form of a rubber damper. The rubber damper is compressed in order to generate the damping force and can be elastically expanded back into its original shape after the end of the application of force.

As already described further above in general terms with respect to the damper, the rubber damper can be arranged along a longitudinal axis of the binding or transverse to it. A scissor-like translation mechanism comprising two scissor elements which are connected to each other in a pivot joint can serve to compress the rubber damper. The joint divides each of the scissor elements into a shorter portion and a longer portion, wherein the shorter portion is coupled to the boot retaining elements, while the longer ends compress the rubber damper. This achieves the desired translation effect.

Instead of an elastically deformable solid body, the compressible body can also comprise an elastic outer skin which is filled with a compressible agent. The compressible body can be formed from a single material or from two or more connected layers of different elastically deformable materials.

As already described with respect to the damping cylinder, the rubber damper can also be surrounded by the restoring spring. This applies to both the scenario in which the restoring spring is arranged along the longitudinal axis of the ski binding or snowboard binding and the scenario in which the restoring spring is arranged transverse to the longitudinal axis of the ski binding or snowboard binding.

The rubber damper or the damping cylinder can especially be surrounded by a restoring spring which is arranged between the two boot retaining elements of a toe retainer, or also by a part of the restoring spring. They can then be arranged in only one of the two partial sleeves which surround the restoring spring, while the other partial sleeve comprises the connecting means which can likewise be surrounded by the restoring spring and which translates the deflection of the at least one boot retaining element onto the damping device, wherein in the case of a toe retainer, it is immaterial whether the boot retaining element acts directly on the connecting means or the damper, since both scenarios result in the same damping of short, hard impacts, such that the respective boot retaining element is prevented from being unintentionally released.

All the damper devices described are suitable for absorbing a force acting on the at least one boot retaining element (a short, hard impact in this case) and amplifying this force via a mechanism, such that a greater force acts on the damper than at the at least one boot retaining element. The damper thus reacts in principle more quickly than the restoring spring to the force applied to the boot retaining element and thus quickly counters the force acting at the boot retaining element with a counterforce in the form of a damping which prevents the restoring spring from being charged with a force which would deflect the boot retaining element. A release of the at least one boot retaining element is thus more securely avoided than with boot retaining units which comprise a damping but no corresponding translation mechanism.

By contrast, the damping does not stop the boot retaining element from being released in the event of a slow impact, for example a fall.

It holds for the entire description and the claims that the expression "a" is used as the indefinite article and the number of parts is not limited to one. Where "a" is intended to mean "only one", this will be understood by the person skilled in the art from the context or is disclosed in an injective way by using suitable expressions such as for example "a single".

In the following, a plurality of embodiments of a boot retaining unit with damping on the basis of a toe retainer are explained in more detail on the basis of figures. Although the figures only show toe retainers, the person skilled in the art will be aware that identical damping devices can also be provided mutatis mutandis for the heel retainer. The different embodiments only show a selection of possible embodiments. The invention is not limited to these embodiments shown. Advantageous features which can be gathered only from the figures, individually and/or in the combinations shown, can advantageously develop the subject-matter of the invention and form part of the scope of the invention.

DETAILED DESCRIPTION OF THE INVENTION

Figure 1:
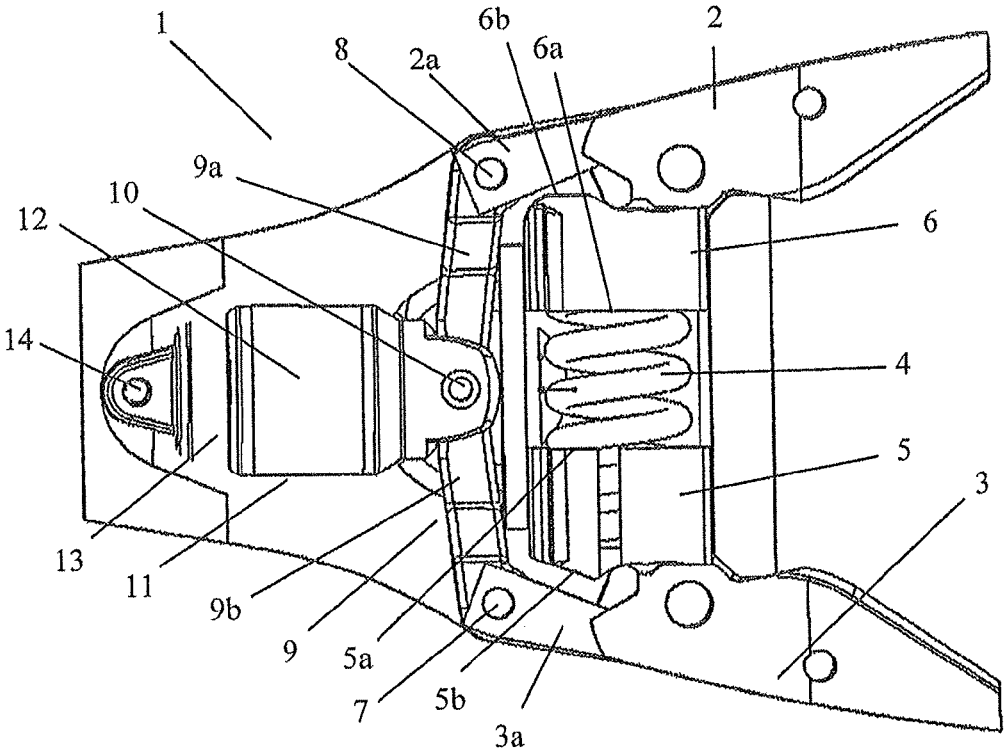
FIG. 1 a boot retaining unit with a direct connection to the translation mechanism in its resting state.

FIG. 1 shows a first embodiment of a boot retaining unit 1 in accordance with the invention for a ski boot or snowboard boot—in this case, a toe retainer. The boot retaining unit 1 comprises two boot retaining elements 2, 3 and a restoring spring 4 which is arranged between the boot retaining elements 2, 3. The restoring spring 4 is trapped in two partial sleeves 5, 6 which determine a maximum expansion of the restoring spring 4 and a maximum compression of the restoring spring 4. The maximum possible compression of the restoring spring 4 is reached when the two opposing ends of the 5*a*, 6*a* of the two partial sleeves 5, 6 contact each other. The maximum expansion of the restoring spring 4 is reached when the two other ends 5*b*, 6*b* of the partial sleeves 5, 6 hold the boot retaining elements 2, 3 in the position shown in FIG. 1.

In the embodiment shown, the boot retaining elements 2, 3 comprise extensions 2*a*, 3*a* at one end which are connected, in a pivot joint 7, 8 each, to a translation mechanism 9. The translation mechanism 9 consists of two transmitting elements 9*a*, 9*b* and is connected in another pivot joint 10 to a damper 11. The translation mechanism 9 can transmit a force occurring at the boot retaining element 2, 3 onto the damper 11, amplifying it in the process.

The damper 11 consists of a damper housing 12 and a damper piston 13 which can be moved in and out of the damper housing 12 and is pivotably connected in another pivot joint 14 to the ski or snowboard. In the resting state, the pivot joints 10 and 14 lie on a common straight line which is spaced equally from the two ends 5*a*, 6*a* of the partial sleeves and the two boot retaining elements 2, 3, i.e. which is a centerline of the boot retaining unit 1.

Figure 2:
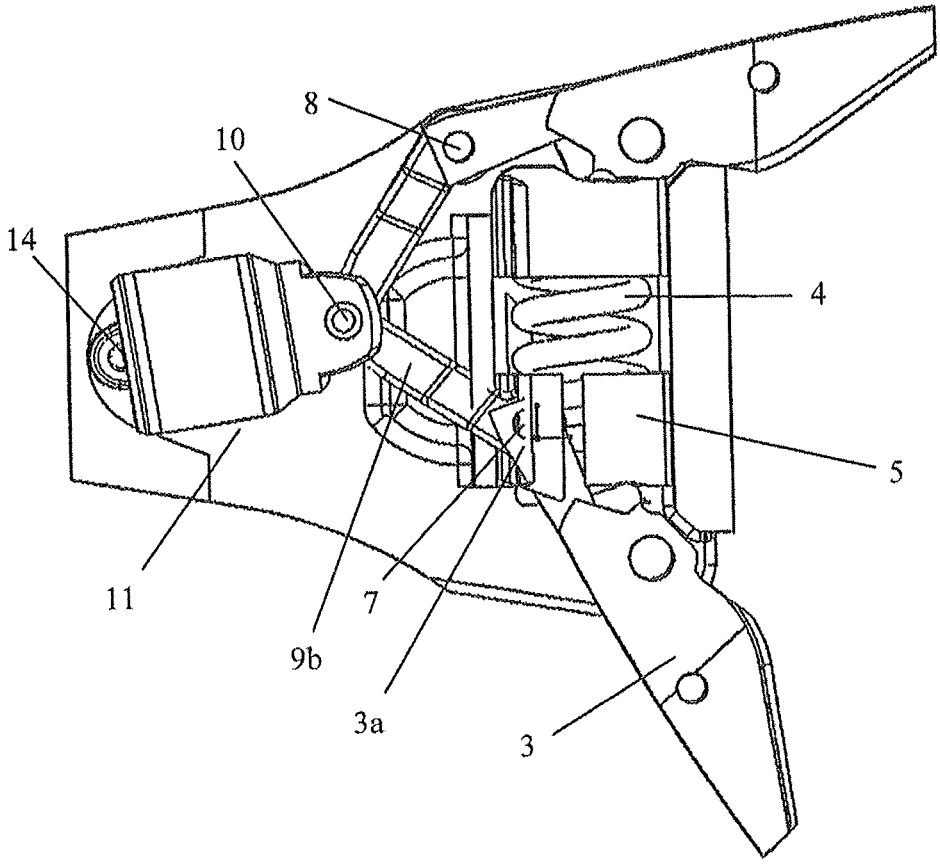
FIG. 2 the boot retaining unit of FIG. 1, with a boot retaining element deflected.

FIG. 2 shows the boot retaining unit of FIG. 1, wherein the boot retaining element 3 has been deflected by a force substantially transverse to the direction of travel. The deflection of the boot retaining element 3 not only partially compresses the restoring spring 4 via the partial sleeve 5, but simultaneously pivots the transmitting element 9*b*, which is connected to the extension 3*a*, in the pivot joint 10. Since the damper 11 cannot give way, the damper piston 13 is pressed into the damper housing 12 and a compressible damping agent contained in the damper 11 is compressed, wherein the damper 11 is additionally pivoted in the pivot joint 14, since the freedom of movement of the damper 11 relative to the ski is substantially predetermined by the four pivot joints 7, 8, 10 and 14.

If a force then ceases to act on the boot retaining element 3, the latter is pressed back into the resting position shown in FIG. 1 by the restoring spring 4. Since the damper 11 is mechanically connected fixedly to the boot retaining elements 2, 3 via the translation mechanism 9, the damping device is also forced back into the resting position shown in FIG. 1 together with the boot retaining element 3.

Figure 3:
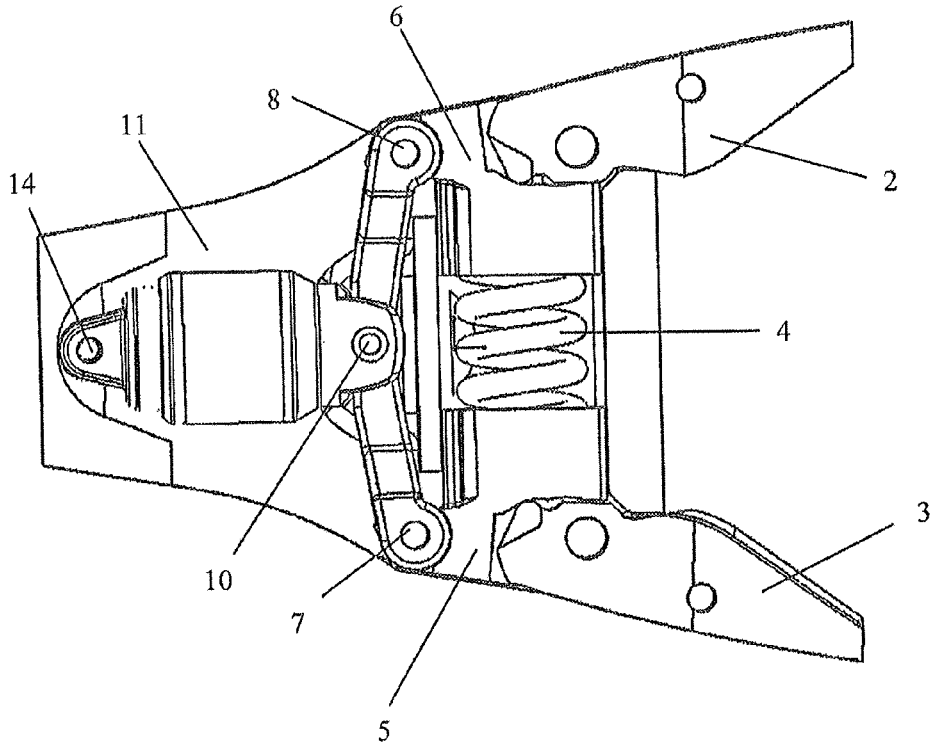
FIG. 3 a boot retaining unit which acts on a linkage which is connected to the translation mechanism.
Figure 4:
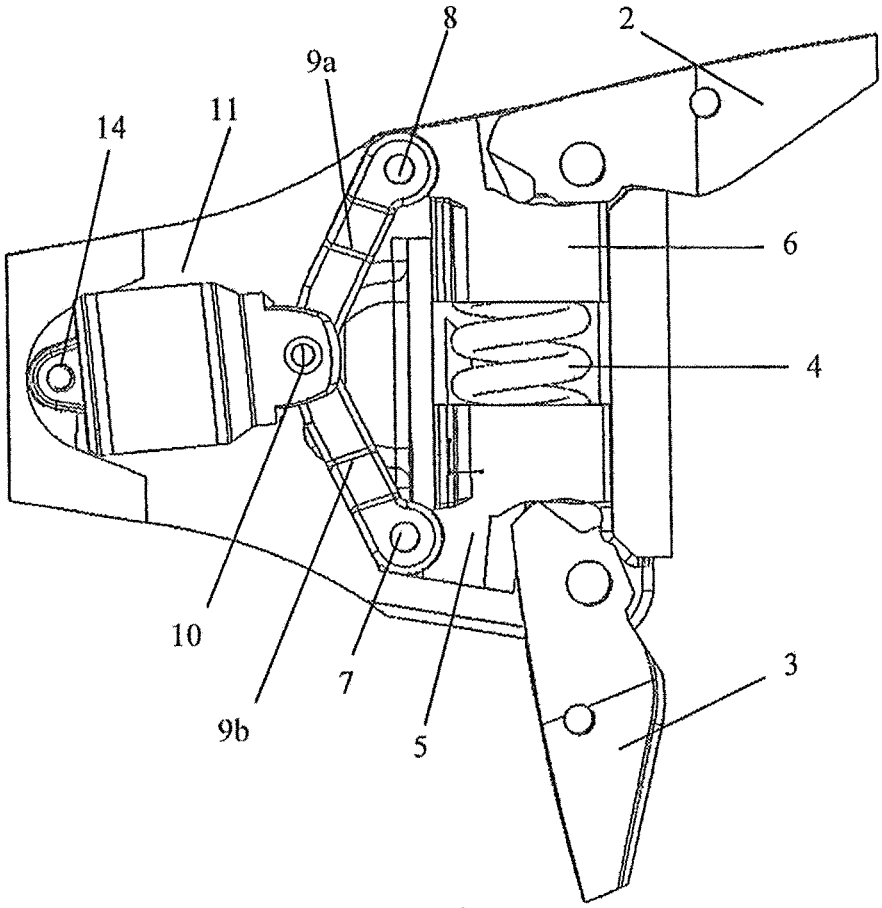
FIG. 4 the boot retaining unit of FIG. 3, with a boot retaining element deflected.

FIGS. 3 and 4 show an alternative embodiment of the boot retaining unit 1 of FIG. 1. The essential difference is that in the example embodiment of FIG. 3, the boot retaining elements 2, 3 do not comprise any extensions and are not coupled to the damper 11 directly but rather via the partial sleeves 5, 6.

The side of the partial sleeves 5, 6 facing away from the boot retaining element comprises a linkage guide for the respective transmitting element 9*a*, 9*b*, wherein the transmitting elements 9*a*, 9*b* can be guided along the linkage and pivoted about pivot axes 7, 8, 10. If one of the partial sleeves 5, 6 is then pressed towards the other of the partial sleeves 5, 6 by the corresponding boot retaining element 2, 3, as shown in FIG. 4, the damper 11 is activated via the pivot joint 10 and the pivot joint 14.

Figure 5:
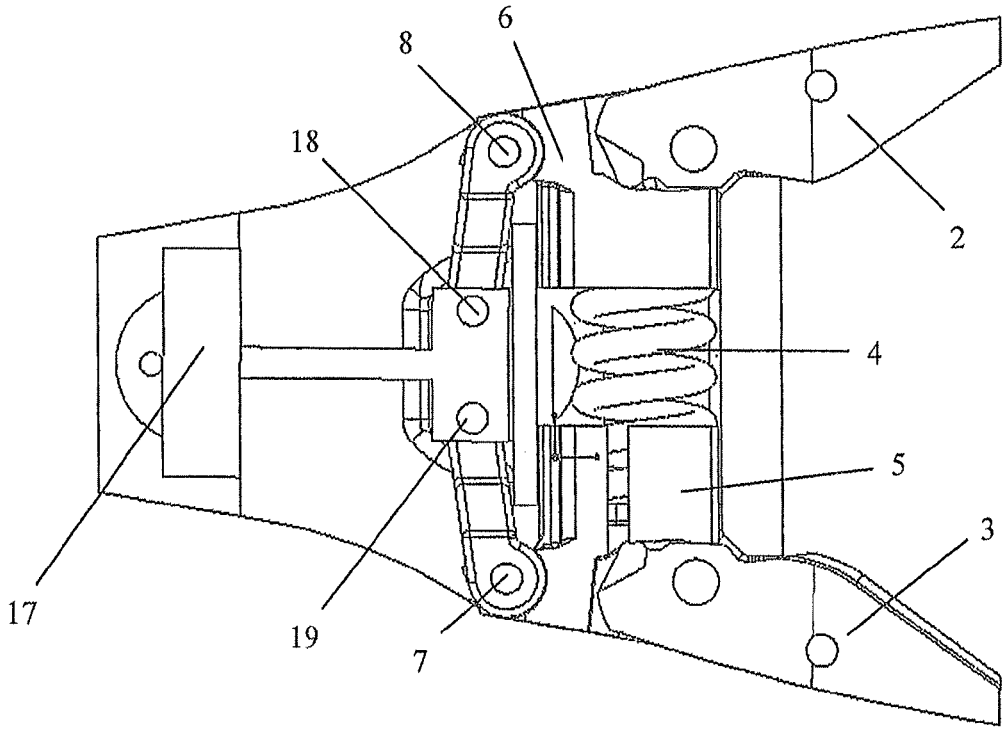
FIG. 5 the boot retaining unit of FIG. 3, with a mass pendulum as the damper.
Figure 6:
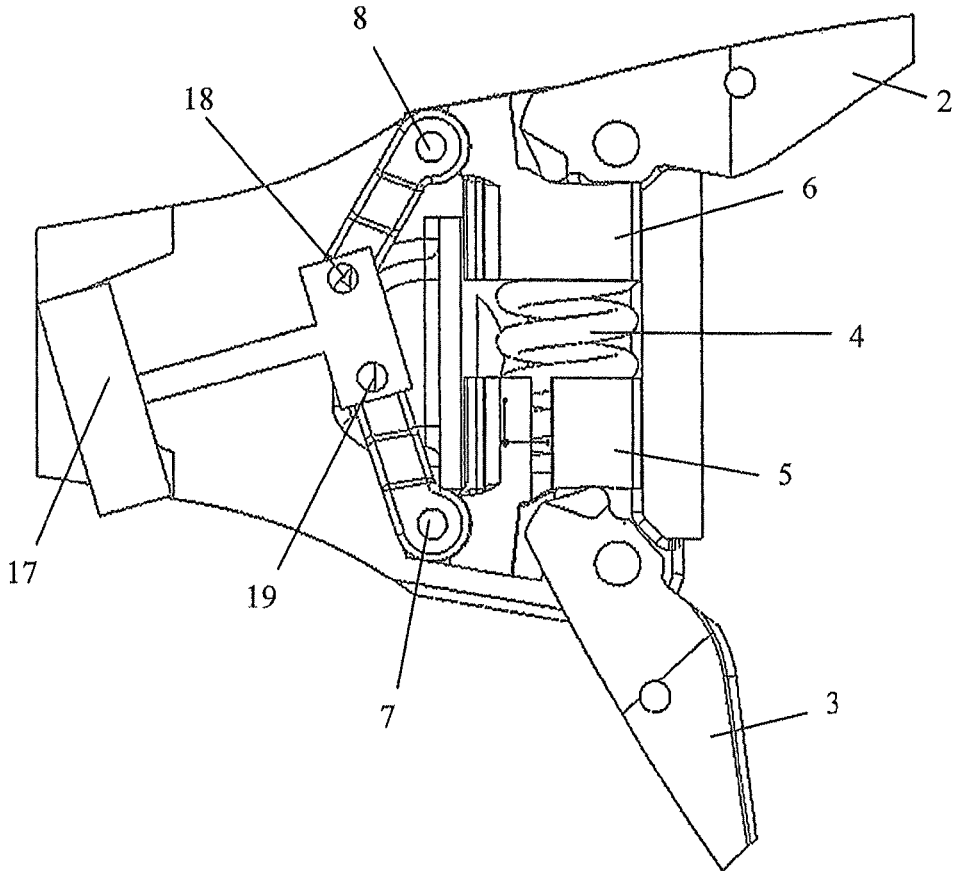
FIG. 6 the boot retaining unit of FIG. 5, with a boot retaining element deflected.

FIGS. 5 and 6 show another embodiment, in which a mass pendulum 17 forms the damper. Unlike the dampers 11 shown thus far, the mass pendulum 17 is connected to the translation mechanism 9 or the transmitting elements 9*a*, 9*b* in two pivot joints 18, 19. The transmitting elements 9*a*, 9*b* can be articulated in the pivot joints 7, 8 via the partial sleeves 5, 6, as shown, or directly by the boot retaining elements 2, 3 and as applicable the extensions 2*a*, 3*a* of the boot retaining elements 2, 3, as known from FIGS. 1 and 2. The mass pendulum 17 is not fixedly connected to the ski or snowboard at one point, but can be guided in a guide, for example a guiding rail, such that it can be raised up from or pressed towards the surface of the ski/snowboard. In this embodiment, a force applied to the boot retaining element 2, 3 is again transmitted by the translation mechanism 9 onto the mass pendulum 17, amplifying it in the process. The larger force which acts on the mass pendulum 17 generates an early damping force which counteracts a compression of the restoring spring 4 and thus prevents the boot retaining element 2, 3 from being released in the event of short, hard impacts.

Figure 7:
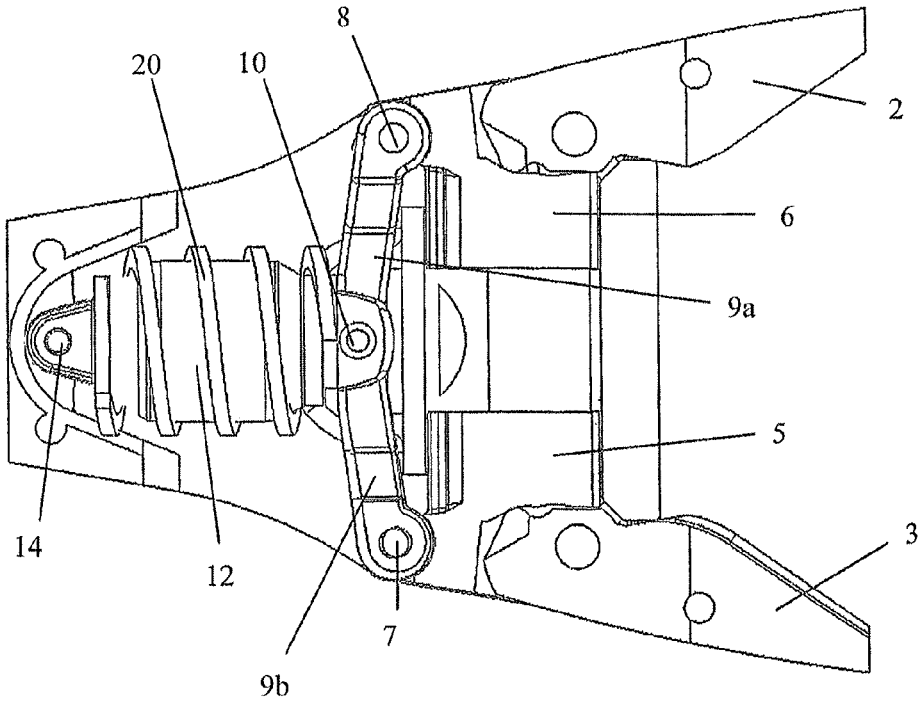
FIG. 7 a boot retaining unit comprising a damper surrounded by the restoring spring.
Figure 8:
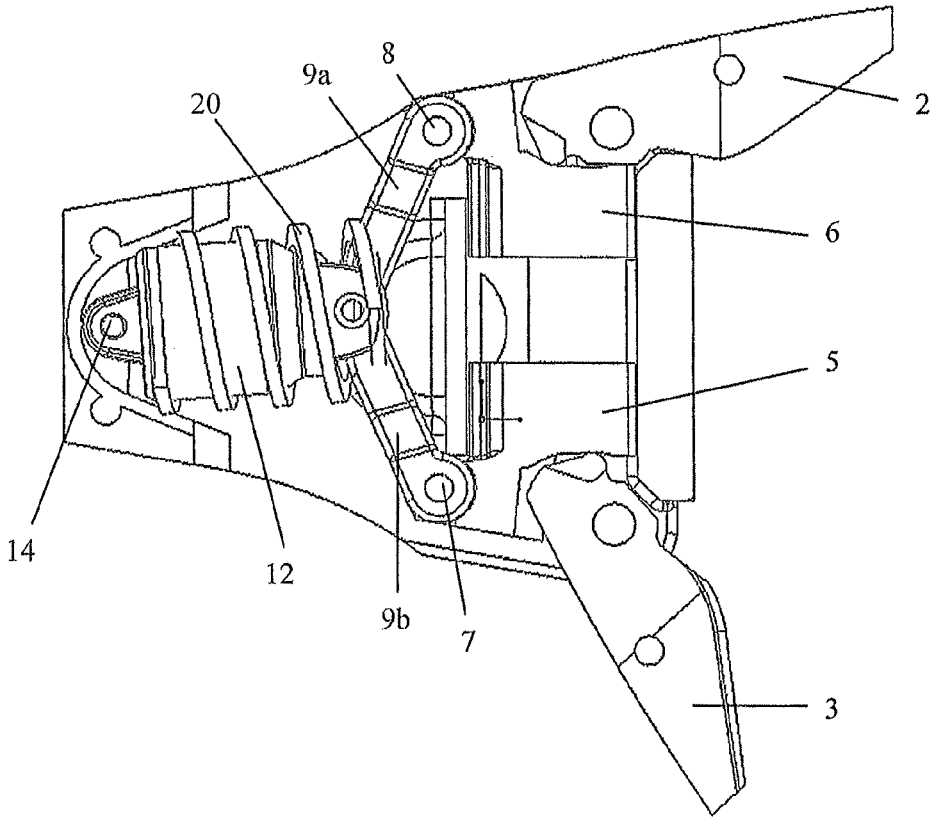
FIG. 8 the boot retaining unit of FIG. 7, with a boot retaining element deflected.

FIGS. 7 and 8 show another embodiment, in which the restoring spring 20 surrounds the damper 11 and connects the damper housing 12 or translation mechanism 9 to the damper piston 13 which is connected to the ski or snowboard in the pivot joint 14. Unlike the embodiments shown thus far, the damper 11 and the restoring spring 20 in this case act in the same direction, namely in the longitudinal direction of the ski binding or snowboard binding, wherein the advantages of damping are the same as those already described with respect to the preceding figures.

In this embodiment, the restoring spring 4 can additionally also be arranged between the partial sleeves 5, 6. The overall spring resistance against a deflection of one of the boot retaining elements 2, 3 is then provided by the two restoring springs 4, 20 together, i.e. the individual spring 4 or 20 can be configured to be weaker.

Figure 9:
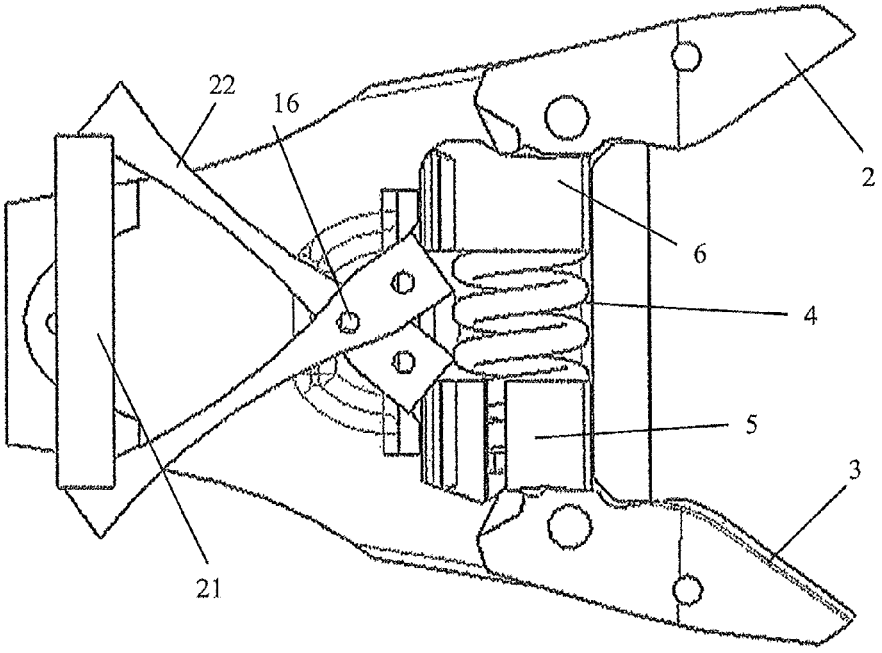
FIG. 9 a boot retaining unit with a rubber damper as the damper.

FIG. 9 shows a sketch of another embodiment of a boot retaining unit 1 with damping. This time, the damper 21 is formed as an elastically deformable solid body which can be compressed by a scissor mechanism 22 which in the example shown is controlled by the partial sleeves 5, 6. The scissor mechanism 22 comprises a scissor joint 16 which generates a lever translation of the movement of for example the partial sleeves 5, 6 onto the damper 21. The boot retaining unit 1 comprises a restoring spring 4 between the two partial sleeves 5, 6.

If, in this example embodiment, the ends of the scissor mechanism 22 which are connected to the two partial sleeves 5, 6 are moved towards each other, the other end of the scissor mechanism 22 closes by a larger distance, i.e. a larger force acts at the damper than at the partial sleeves 5, 6. This generates the desired early damping of the force occurring at the boot retaining element 2, 3, which prevents the boot retaining element 2, 3 from being released due to short, hard impacts.

Figure 10:
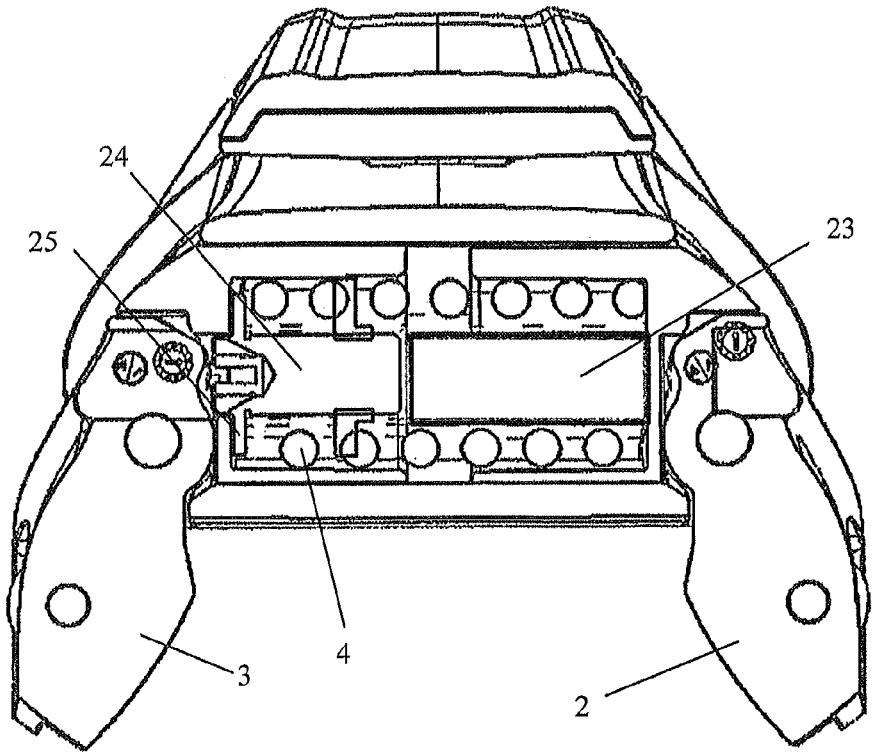
FIG. 10 a boot retaining unit comprising two boot retaining elements and a restoring spring arranged between them and a damper extending parallel to the spring.

Lastly, FIG. 10 shows an embodiment in which the damper 23, the translation mechanism 24 and the restoring spring 4 are arranged between or partially in the partial sleeves 5, 6, wherein the restoring spring 4 completely surrounds the damper 23 and partially surrounds the translation mechanism 24. The side of the translation mechanism 24 facing the partial sleeve 5 comprises a collar 25 exhibiting a diameter which substantially corresponds to the outer diameter of the restoring spring 4. A force acting on the boot retaining element 3 is thus transmitted onto the restoring spring 4 and the damper 23 simultaneously. The damper 23 can for example be formed as is known from FIGS. 1 to 4 and 9, i.e. can comprise a damper housing and a damper piston, or can be an elastically deformable solid body.

In the example embodiment of FIG. 10, the restoring spring 4 and the damper 23 are aligned transversely with respect to the longitudinal direction of the ski binding or snowboard binding and extend parallel to each other. The damper arrangement in FIG. 10 exhibits a very compact design with few interconnected parts. This for example enables a toe retainer with damping to be designed to be very short, for example as short as if it did not comprise any damping.

Although possible embodiments of the invention have been disclosed in the preceding description, it will be understood that numerous other variants of embodiments exist due to possible combinations of all the cited technical features and embodiments and furthermore all the technical features and embodiments which will be obvious to the person skilled in the art. It will also be understood that the example embodiments are to be understood merely as examples which in no way limit the scope of protection, the susceptibility of application and the configuration of the invention. The preceding description is instead intended to show the person skilled in the art a suitable way of realizing at least one example embodiment. It will be understood that numerous changes with respect to the function and arrangement of elements can be made to an example embodiment without departing from the scope of protection disclosed in the claims and its equivalents.

LIST OF REFERENCE SIGNS

1 boot retaining unit
2 boot retaining element
3 boot retaining element
4 restoring spring
5 partial sleeve
5*a* end of the partial sleeve
6 partial sleeve
6*a* end of the partial sleeve
7 pivot joint
8 pivot joint
9 translation mechanism
9*a* transmitting element
9*b* transmitting element
10 pivot joint
11 damper
12 damper housing
13 damper piston
14 pivot joint
15 pivot joint
16 scissor joint
17 mass pendulum, damper

18 pivot joint
19 pivot joint
20 spring
21 damper, rubber damper
22 scissor mechanism, translation mechanism
23 damper
24 translation mechanism
25 collar

The invention claimed is:

1. A boot retaining unit of a ski binding or snowboard binding, comprising a) at least one boot retaining element, b) a restoring spring for the boot retaining element, and c) a damping device for absorbing short, hard impacts, wherein d) the at least one boot retaining element and the damping device are connected via a translation mechanism, and e) the translation mechanism translates a deflection of the at least one boot retaining element into a larger deflection of the damping device.

2. The boot retaining unit according to claim 1, wherein the translation mechanism comprises at least one transmitting element which transmits the deflection of the at least one boot retaining element onto a damper of the damping device.

3. The boot retaining unit according to claim 2, wherein the transmitting element comprises a first end which is coupled to the at least one boot retaining element and a second end which is coupled to the damper.

4. The boot retaining unit according to claim 3, wherein the first end is coupled to the boot retaining element in a pivot joint and the second end is coupled to the damper in a pivot joint.

5. The boot retaining unit according to claim 4, wherein the boot retaining element forms a first lever arm of a lever and the transmitting element forms a second lever arm of the lever and the first and second lever arms are of different lengths.

6. The boot retaining unit according to claim 3, wherein the translation mechanism comprises two transmitting elements which are coupled to the damper in the pivot joint.

7. The boot retaining unit according to claim 2, wherein the damper is connected to the ski or snowboard in a pivot joint.

8. The boot retaining unit according to claim 2, wherein the damper is arranged transverse or parallel to a longitudinal axis of the ski binding or snowboard binding.

9. The boot retaining unit according to claim 1, wherein the restoring spring for the boot retaining element is simultaneously a spring for restoring the damping device from an activated state to its resting state.

10. The boot retaining unit according to claim 1, wherein the restoring spring is arranged transverse or parallel to a longitudinal axis of the ski binding or snowboard binding.

11. The boot retaining unit according to claim 1, wherein the at least one boot retaining element is coupled to the translation mechanism directly or via a linkage.

12. The boot retaining unit according to claim 1, wherein the damping device comprises a damper in the form of a damper housing which is filled with a damping agent and which comprises a damper piston.

13. The boot retaining unit according to claim 12, wherein the restoring spring surrounds the damper housing and the damper piston.

14. The boot retaining unit according to claim 1, wherein the damping device comprises a damper in the form of a mass pendulum.

15. The boot retaining unit according to claim 1, wherein the damping device comprises a damper in the form of a rubber damper.

* * * * *